US007540708B2

(12) United States Patent
Laurer et al.

(10) Patent No.: US 7,540,708 B2
(45) Date of Patent: Jun. 2, 2009

(54) METHODS AND APPARATUS TO FACILITATE SEALING IN A TURBINE

(75) Inventors: Kurt Neal Laurer, Saratoga Springs, NY (US); Kevin Joseph Barh, Halfmoon, NY (US); Bernard Arthur Couture, Schenectady, NY (US); Jason Paul Mortzheim, Gloversville, NY (US)

(73) Assignee: General Electric Company, Schenectady, NY (US)

( * ) Notice: Subject to any disclaimer, the term of this patent is extended or adjusted under 35 U.S.C. 154(b) by 398 days.

(21) Appl. No.: 11/427,866

(22) Filed: Jun. 30, 2006

(65) Prior Publication Data

US 2008/0003100 A1 Jan. 3, 2008

(51) Int. Cl.
*F01D 11/00* (2006.01)

(52) U.S. Cl. ..... 415/170.1; 415/174.2; 415/174.4; 415/174.5; 415/231

(58) Field of Classification Search ..... 415/170.1, 415/174.2, 174.4, 174.5, 213, 231
See application file for complete search history.

(56) References Cited

U.S. PATENT DOCUMENTS 2,600,991 A * 6/1952 Hargrove ..... 277/416
3,594,010 A * 7/1971 Warth ..... 415/231
4,436,311 A * 3/1984 Brandon ..... 277/413
4,538,790 A 9/1985 Williams et al.
4,558,874 A 12/1985 Williams et al.
5,002,288 A * 3/1991 Morrison et al. ..... 415/174.5
5,037,114 A 8/1991 Gray
5,161,943 A 11/1992 Maier et al.
5,395,124 A 3/1995 Brandon
5,603,510 A * 2/1997 Sanders ..... 415/173.3
5,639,095 A 6/1997 Rhode
5,704,614 A * 1/1998 Sanders et al. ..... 29/402.02
5,934,684 A 8/1999 Brandon et al.
6,007,070 A 12/1999 Heathcott et al.
6,065,754 A 5/2000 Cromer et al.
6,131,910 A 10/2000 Bagepalli et al.
6,220,603 B1 4/2001 Brandon et al.
6,250,641 B1 6/2001 Dinc et al.
6,311,983 B1 11/2001 Burcham
6,651,986 B2 * 11/2003 Chevrette et al. ..... 277/421
2004/0096319 A1 * 5/2004 Uchida et al. ..... 415/174.5

* cited by examiner

*Primary Examiner*—Igor Kershteyn
(74) *Attorney, Agent, or Firm*—Armstrong Teasdale LLP

(57) ABSTRACT

A method of assembling a seal assembly for a turbine engine is provided, wherein the method includes providing a seal ring having an arcuate inner ring portion, an arcuate outer ring portion, and a neck portion extending therebetween, and forming at least one recess within at least one of the outer ring portion and the neck portion. The method also includes extending a biasing mechanism across the seal ring such that the biasing mechanism is positively retained within the at least one recess.

17 Claims, 12 Drawing Sheets

METHODS AND APPARATUS TO FACILITATE SEALING IN A TURBINE

BACKGROUND OF THE INVENTION

This invention relates generally to turbines, and, more particularly, to seal ring assemblies for use with turbines.

At least some known seal assemblies used with turbines are biased open by a spring coupled thereto. More specifically, the spring induces a radially outward biasing force against a seal ring that increases a diameter of the seal ring. As pressure is increased within the turbine, the biasing force induced by the spring must be overcome to decrease the diameter of the seal ring to facilitate preventing steam flow through the seal assembly within the turbine. Accordingly, in such sealing assemblies, radial inward travel of the seal ring is generally delayed until pre-determined operating conditions for the turbine are attained.

At least some known seal assembly springs may be installed in the field during final assembly of the turbine. Specifically, the springs may be temporarily positioned against the seal ring using re-roundable dowels which do not provide positive retention and only retain the spring after the seal ring is installed in the packing assembly. As such the spring may fall out or be deformed during installation of the seal ring. Moreover, the seal ring can not be shipped with the spring pre-installed. Accordingly, such seal ring/spring assemblies may increase installation time, decrease quality, and increase overall costs associated with installation of the seal assembly.

BRIEF DESCRIPTION OF THE INVENTION

In one aspect, a method of assembling a seal assembly for a turbine engine is provided, wherein the method includes providing a seal ring having an arcuate inner ring portion, an arcuate outer ring portion, and a neck portion extending therebetween, and forming at least one recess within at least one of the outer ring portion and the neck portion. The method also includes extending a biasing mechanism across the seal ring such that the biasing mechanism is positively retained within the at least one recess.

In another aspect, a seal assembly for a turbine engine is provided, wherein the seal assembly includes a seal ring comprising an arcuate inner ring portion, an arcuate outer ring portion, and a neck portion extending therebetween. The seal assembly also includes at least one recess formed within at least one of the seal ring outer ring portion and the seal ring neck portion, and a biasing mechanism extending chordially across the seal ring and retained within the at least one recess.

In a further aspect, a turbine engine is provided, wherein the turbine engine includes a seal assembly configured to reduce steam leakage within the turbine engine. The seal assembly includes a seal ring comprising an arcuate inner ring portion, an arcuate outer ring portion, and a neck portion extending therebetween. The seal assembly also includes at least one recess formed within at least one of the seal ring outer ring portion and the seal ring neck portion, and a biasing mechanism extending chordially across the seal ring and retained within the at least one recess.

DETAILED DESCRIPTION OF THE INVENTION

Figure 1:
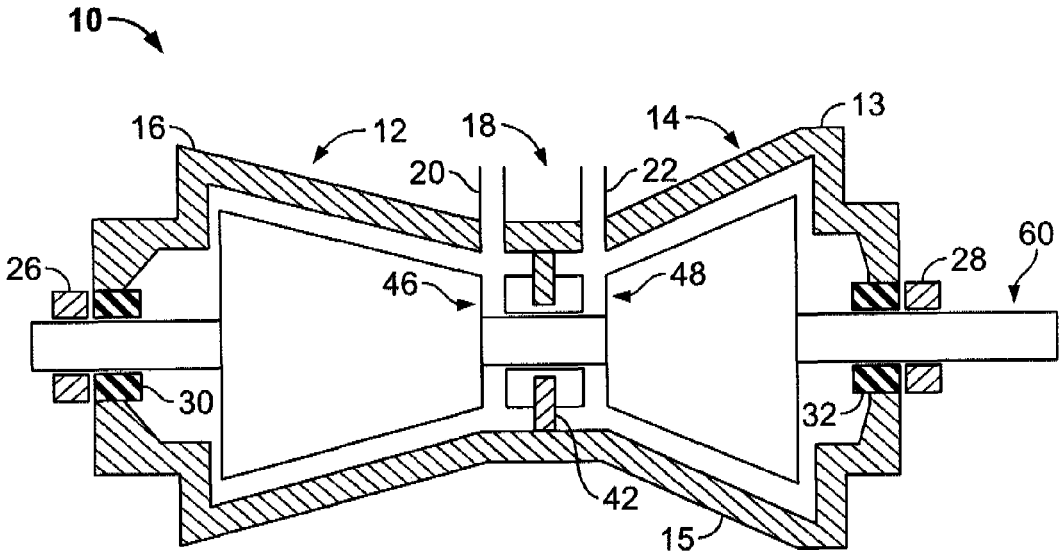
FIG. 1 is a schematic illustration of an exemplary opposed flow High Pressure (HP)/Intermediate Pressure (IP) steam turbine.

FIG. 1 is a schematic illustration of an exemplary opposed-flow steam turbine 10 including a high pressure (HP) section 12 and an intermediate pressure (IP) section 14. An outer shell or casing 16 is divided axially into upper and lower half sections 13 and 15, respectively, and spans both HP section 12 and IP section 14. A central section 18 of shell 16 includes a high pressure steam inlet 20 and an intermediate pressure steam inlet 22. Within casing 16, HP section 12 and IP section 14 are arranged in a single bearing span supported by journal bearings 26 and 28. A steam seal unit 30 and 32 is located inboard of each journal bearing 26 and 28, respectively.

An annular section divider 42 extends radially inwardly from central section 18 towards a rotor shaft 60 that extends between HP section 12 and IP section 14. More specifically, divider 42 extends circumferentially around a portion of rotor shaft 60 between a first HP section nozzle 46 and a first IP section nozzle 48.

During operation, high pressure steam inlet 20 receives high pressure/high temperature steam from a steam source, for example, a power boiler (not shown). Steam is routed through HP section 12 wherein work is extracted from the steam to rotate rotor shaft 60. The steam exits HP section 12 and is returned to the boiler wherein it is reheated. Reheated steam is then routed to intermediate pressure steam inlet 22 and returned to IP section 14 at a reduced pressure than steam entering BP section 12, but at a temperature that is approximately equal to the temperature of steam entering HP section 12. Accordingly, an operating pressure within HP section 12 is higher than an operating pressure within IP section 14, such that steam within HP section 12 tends to flow towards IP section 14 through leakage paths that may develop between HP section 12 and IP section 14.

Figure 2:
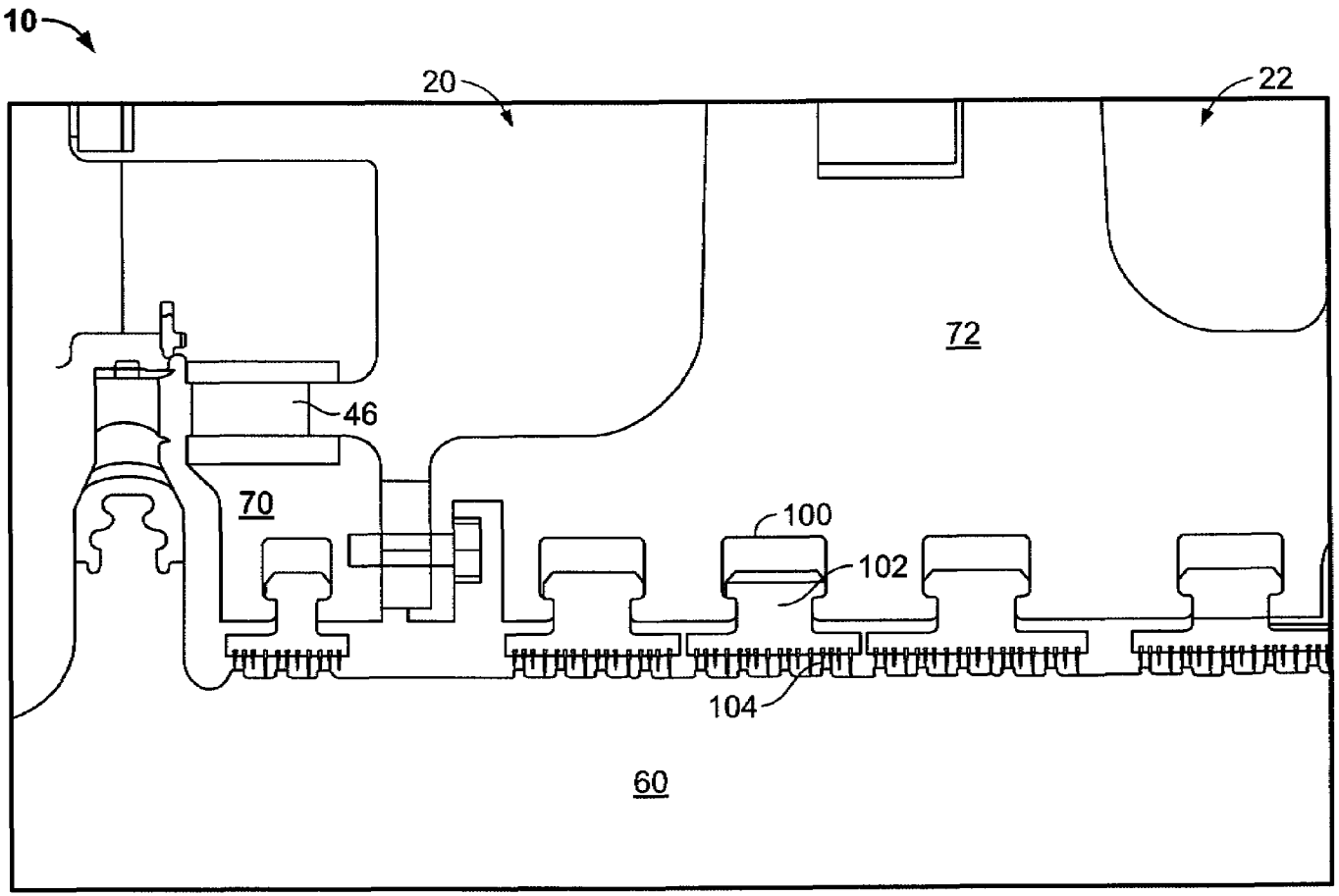
FIG. 2 is an enlarged schematic illustration of a turbine nozzle diaphragm and a packing casing that may be used with the steam turbine shown in FIG. 1.

FIG. 2 is an enlarged schematic illustration of an exemplary turbine nozzle diaphragm 70 and a packing casing 72 that may be used with turbine 10. In the exemplary embodiment, nozzle diaphragm 70 is a first stage diaphragm used with high pressure turbine 12. Moreover, in the exemplary embodiment packing casing 72 includes a plurality of labyrinth seal assemblies 100 that facilitate reducing leakage from HP section 12 to IP section 14 along rotor shaft 60. Labyrinth seal assemblies 100 include longitudinally spaced-apart rows of teeth 104 attached to a seal ring 102 that facilitate sealing against operating pressure differentials that may be present in a steam turbine such as turbine 10.

In operation, steam at higher pressure in HP section 12 tends to leak through a steam path defined between first stage nozzle diaphragm 70 and packing casing 72 to IP section 14, an area at a lower operating pressure. For example, in one embodiment, high pressure steam is admitted to HP section 12 at approximately 1800 pounds per square inch absolute (psia), and reheat steam is admitted to IP section 14 at between approximately 300-400 psia. Accordingly, a relatively large pressure drop across packing casing 72 may cause steam to leak around packing casing 72 along rotor shaft 60 resulting in a reduction in steam turbine efficiency.

Figure 3:
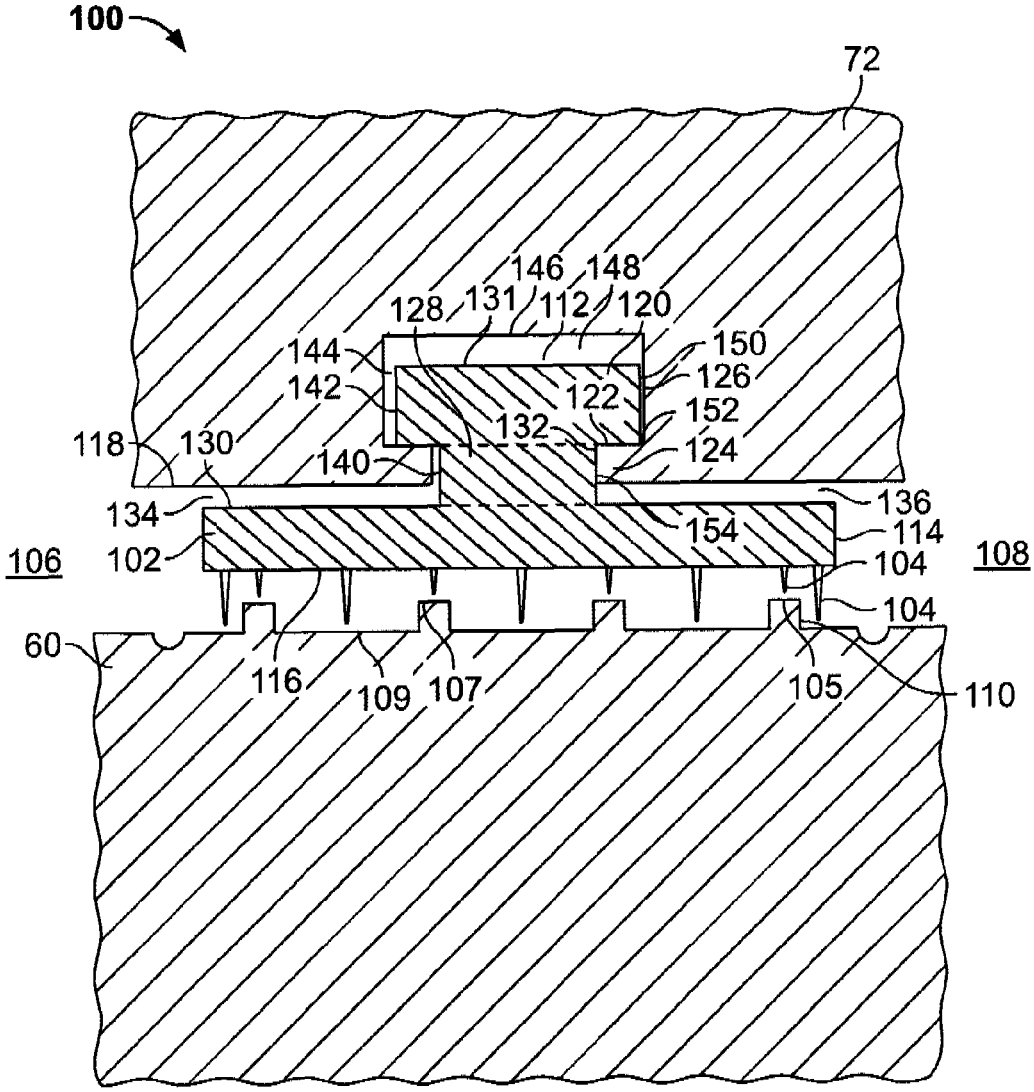
FIG. 3 is an exemplary embodiment of a labyrinth seal assembly that may be used with the steam turbine shown in FIG. 1.

FIG. 3 is an exemplary embodiment of a labyrinth seal assembly 100 that may be used with turbine 10. In FIG. 3 only a portion of rotor shaft 60 and a portion of casing 72 are illustrated. Furthermore, although only a single seal ring 102 is illustrated, several such rings could be arranged in series as shown in FIG. 2. In alternative embodiments, labyrinth seal assemblies 100 are used to facilitate sealing in other areas of turbine 10.

Seal ring 102 includes a plurality of teeth 104 positioned in opposition to a plurality of rotor shaft circumferential projections 105 extending outward from rotor shaft 60. In the exemplary embodiment, each circumferential projection 105 includes radially outer rotor surfaces 107 positioned between a plurality of radially inner rotor surfaces 109. As explained above, a positive force may force fluid flow between the multiple restrictions formed by a clearance area 110 defined between teeth 104 and rotor shaft 60. More specifically, the combination of clearance area 110, the number, and relative sharpness, of teeth 104, the number of rotor shaft circumferential projections 105, and the operating conditions, including pressure and density, are factors that determine the amount of leakage flow. Alternately, other geometrical arrangements can also used to provide multiple or single leakage restrictions. For example, in an alternative embodiment, rotor portion 60 does not include teeth 105 or surfaces 109, but rather, is substantially planar. In another embodiment, seal ring 102 does not include a serpentine path with the rotor teeth. Further, in yet another embodiment, seal ring 102 may include a brush seal or any other suitable sealing mechanism.

Each seal ring 102 is retained in a casing groove 112 defined in casing 72. In one embodiment, each seal ring 102 includes a plurality of seal ring segments (not shown in FIG. 3) that may be positioned within casing groove 112 to facilitate ease of assembly or disassembly of casing 72. In the exemplary embodiment, a system of springs (not shown in FIG. 3) induces a force that will tend to enlarge a diameter of seal ring 102 and a second system of springs (not shown in FIG. 3) may be used to counter the force induced by the weight of seal ring 102.

Each seal ring 102 includes an inner ring portion 114 having teeth 104 extending from a radially inner surface 116, and a radially outer surface 130 that facilitates controlling clearance area 110 by contacting a radial surface 118 of casing 72. Each seal ring 102 also includes an outer ring portion 120 that is positioned within casing groove 112. Outer ring portion 120 includes an inner circumferential surface 122 and an opposite radially outer surface 131. Inner circumferential surface 122 contacts an outer surface 126 of a casing groove shoulder 124 such that radial inward movement of seal ring 102 is limited. Seal ring 102 also includes a neck portion 128 extending between seal ring inner ring portion 114 and seal ring outer ring portion 120. Casing groove shoulder 124 interacts with seal ring neck portion 128 to axially locate each seal ring 102. Seal ring neck portion 128 includes a contact pressure surface 132 that contacts casing groove shoulder 124.

One steam flow path through labyrinth seal assembly 100 is defined from high pressure region 106 to low pressure region 108 through clearance area 110 and between teeth 104 and rotor shaft surfaces 107 and 109. Steam flow is modulated as a function of radial positioning of seal ring 102. As seal ring 102 moves radially outward, the overall size of clearance area 110 increases and steam flow through clearance area 110 increases. Conversely, as seal ring 102 moves radially inward, clearance area 110 decreases and steam flow through clearance area 110 decreases.

A second steam flow path is defined from high pressure annular space 134 to low pressure annular space 136 through casing groove 112. Steam at a higher pressure may flow from annular space 134 through an annular opening 140 defined between casing groove shoulder 124 and seal ring neck portion 128. Steam is channeled through opening 140 to a high pressure region 142 defined between casing groove shoulder outer surface 126 and seal ring outer ring portion ring circumferential surface 122 before entering a casing groove high pressure portion 144 defined by the casing 72 and seal ring outer ring portion 120. Steam exits casing groove high pressure portion 144 and enters a casing groove radially outer portion 148 defined between a casing groove radially outer surface 146 and seal ring outer portion radially outer surface 131. Steam may then flow to a low pressure portion 150 defined by the casing 72 and seal ring outer ring portion 120 and to a low pressure side shoulder region 152 defined between casing groove shoulder outer surface 126 and seal ring outer ring portion inner circumferential surface 122. Steam exits low pressure side shoulder region 152 through an annular opening 154 defined between casing groove shoulder 124 and seal ring neck portion 128, wherein the steam is discharged into annular space 136.

Radially outward travel of seal ring 102 is limited when seal ring outer surface 130, or any portion thereof, contacts casing radial surface 118. This position is referred to as the fully retracted position. Radially inward travel of seal ring 102 is limited when seal ring surface 122 contacts casing groove shoulder surface 126. This position is referred to as the fully inserted position. Sufficient space to accommodate expected transient misalignments of rotor shaft 60 and casing 72, without incurring damage to teeth 104, is provided for.

At low or no load operating conditions, the weight of seal ring 102, the confining limits of casing 72, frictional forces, and the forces of a plurality of biasing spring systems (not shown on FIG. 3) act on seal ring 102. The overall effect is that seal ring 102 is biased to a diameter as limited by the radially outward limit of travel of seal ring 102.

Internal pressures throughout the turbine 10 are substantially proportional to load. As load and steam mass flow are each increased, local pressures increase in a substantially linear fashion. This relationship can be used to determine desired positions of seal ring 102 at pre-determined turbine operating conditions. For example, as steam flow to turbine 10 is increased, steam pressure in annular space 134 and in casing groove 112 is likewise increased. The increased steam pressure exerts a radially inward force to seal ring 102 that is substantially carried by seal ring outer surfaces 130 and 131.

The increased steam pressure in high pressure region 106 induces increased steam flow via casing groove 112 through annular space 134, annular opening 140, shoulder region 142, casing groove high pressure portion 144, casing groove radially outer portion 148, casing groove low pressure portion 150, shoulder region 152, and annular opening 154 into annular region 136. The increased steam pressure in high pressure region 106 also induces increased pressures in the path defined from annular space 134 to annular space 136 via casing groove 112 as described above. The pressures in each subsequent region of the path are less than the regions preceding them. For example, the steam pressure in casing groove low pressure portion 150 is less than the steam pressure in casing groove high pressure portion 144. This pressure differential induces an increased force to the right on seal ring inner ring portion 114, seal ring neck portion 128 and seal ring outer ring portion 120. The increased forces on these surfaces causes seal ring 102 to move axially toward the low pressure region 108 until seal ring neck contact pressure surface 132 contacts casing groove shoulder 124. When fully inserted steam flow from high pressure annular space 134 to low pressure annular space 136 via casing groove 112 is substantially prevented by seal ring 102.

The condition illustrated above causes steam pressure to induce an increased radially inward force to surfaces 130 and 131 as described above. The increased steam pressure also induces an increased radially inward force to seal ring 102 to overcome the previously discussed frictional forces and plurality of biasing spring sub-systems (not shown) forces.

The dimensions of seal ring 102 and casing groove 112 are selected to facilitate optimizing the clearance 110 defined between teeth 104 and rotor shaft 60 surface for loaded, steady state operation.

Figure 4:
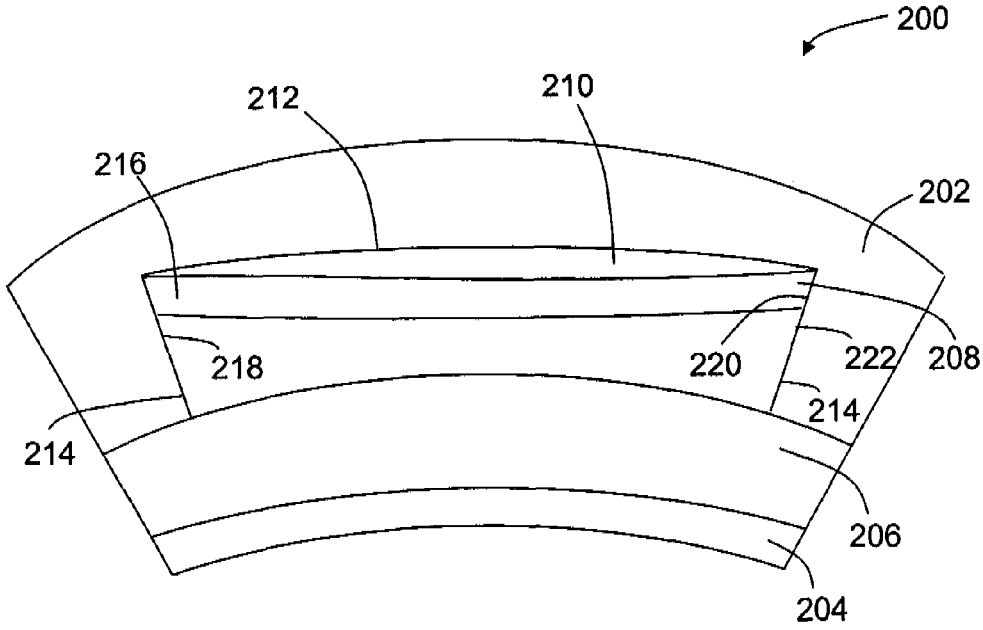
FIG. 4 is an exemplary embodiment of a seal ring that may be used with the labyrinth seal assembly shown in FIG. 3.

FIG. 4 is an exemplary embodiment of a seal ring 200 that may be used with labyrinth seal assembly 100, Seal ring 200 includes an outer ring portion 202, an inner ring portion 204, and a neck portion 206 extending therebetween. Seal ring 200 also includes a biasing mechanism 208 retained within a cavity 210. In the exemplary embodiment, biasing mechanism 208 is a spring. Specifically, cavity 210 is formed within outer ring portion 202 and includes an arcuate top wall 212 and a pair of opposing sidewalls 214. Alternatively, cavity 210 may be formed in seal ring neck portion 206, Biasing mechanism 208 extends between sidewalls 214. Specifically a first end 216 of biasing mechanism 208 contacts a first side wall 218, and a second end 220 of biasing mechanism 208 contacts a second side wall 222. In the exemplary embodiment, biasing mechanism 208 is positively retained within cavity 210 in a friction fit created between biasing mechanism ends 216 and 220 and side walls 214. In an alternative embodiment, biasing mechanism 208 may be retained within cavity 210 by any one oft but not limited to, a tack weld, a screw, a pin, and/or glue.

Figure 5:
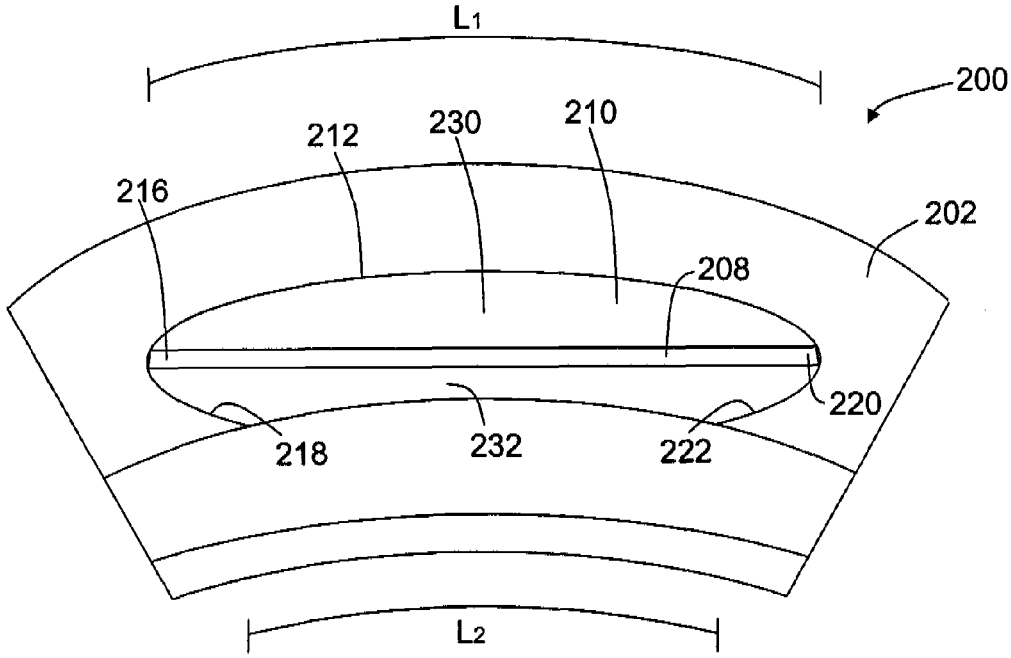
FIG. 5 is an alternative embodiment of the seal ring shown in FIG. 4.

FIG. 5 is an alternative embodiment of seal ring 200 wherein sidewalls 214 of cavity 210 are angled. Specifically each side wall 218 and 222 extends radially inward from top wall 212 such that sidewalls 218 and 222 are angled toward on another. As such a radially outward portion 230 of cavity 210 has a longer arcuate length $L_1$ than an arcuate length $L_2$ of a radially inward portion 232 of cavity 210. Biasing mechanism 208 is positively retained within radially outward portion 230 by sidewalls 218 and 222. Specifically each sidewall 218 and 222 provides an interference fit for biasing mechanism 208 such that biasing mechanism 208 is prevented from moving radially inward toward radially inward portion 232. In the exemplary embodiment, biasing mechanism 208 is positively retained within cavity 210 in a friction fit created between biasing mechanism ends 216 and 220 and sidewalls 214. In an alternative embodiment, biasing mechanism 208 may be retained within cavity 210 by any one of, but not limited to, a tack weld, a screw, a pin, and/or glue.

Figure 6:
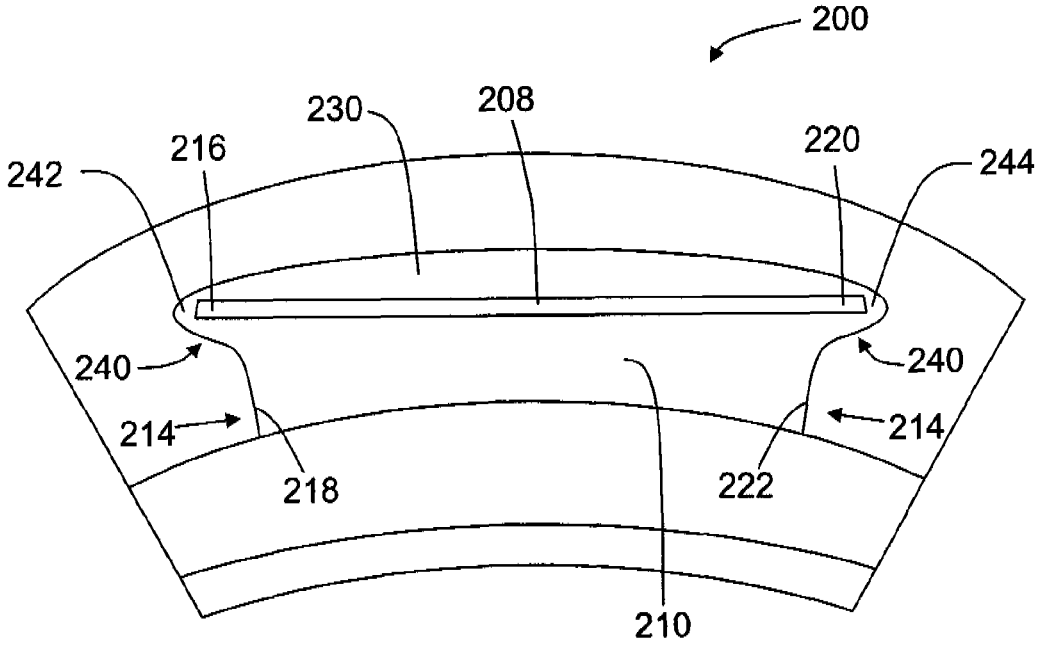
FIG. 6 is another embodiment of the seal ring shown in FIG. 4.

FIG. 6 is another embodiment of seal ring 200 wherein cavity 210 includes a pair of notches 240. Specifically, each notch 240 is formed within one of sidewalls 214 within cavity radially outward portion 230. More specifically, a first notch 242 is formed within first sidewall 218 and a second notch 244 is formed within second sidewall 222. Notches 240 are each sized to retain an end of biasing mechanism 208. Specifically, first notch 242 retains biasing mechanism first end 216, and second notch 244 retains biasing mechanism second end 220. In the exemplary embodiment, biasing mechanism 208 is positively retained within cavity 210 in a friction fit created between biasing mechanism ends 216 and 220 and notches 242 and 244, respectively. In an alternative embodiment, biasing mechanism 208 may be retained within notches 242 and 244 by any one of, but not limited to, a tack weld, a screw, a pin, and/or glue.

Figure 7:
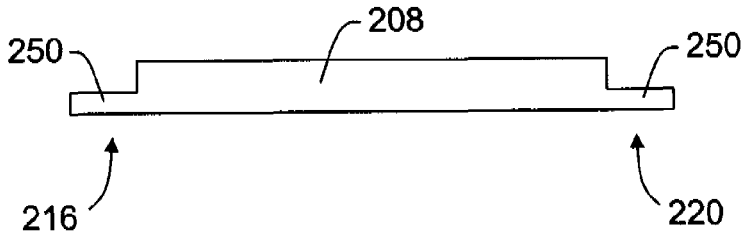
FIG. 7 is a view of a biasing mechanism that may be used with the labyrinth seal assembly shown in FIG. 3.
Figure 8:
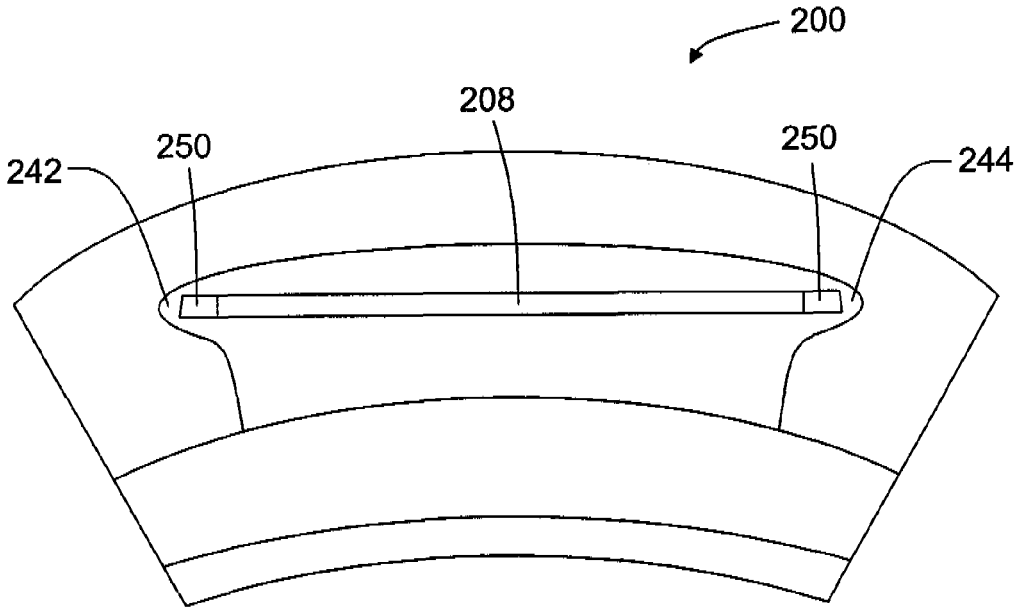
FIG. 8 is a view of the biasing mechanism shown in FIG. 7 and coupled within the seal ring shown in FIG. 6.

FIG. 7 is a view of biasing mechanism 208 including a tab 250 extending axially from each biasing mechanism end 216 and 220; and FIG. 8 is a view of biasing mechanism 208 having tabs 250 and coupled within seal ring 200 shown in FIG. 6. Tabs 250 are used to provide additional length to biasing mechanism 208 and to provide a positive engagement of notches 242 and 244. Biasing mechanism 208 is positively retained within cavity 210 in a friction fit created between tabs 250 and notches 242 and 244. Alternatively, tabs 250 may be retained within notches 242 and 244 by any one of, but not limited to, a tack weld, a screw, a pin, and/or glue.

Figure 9:
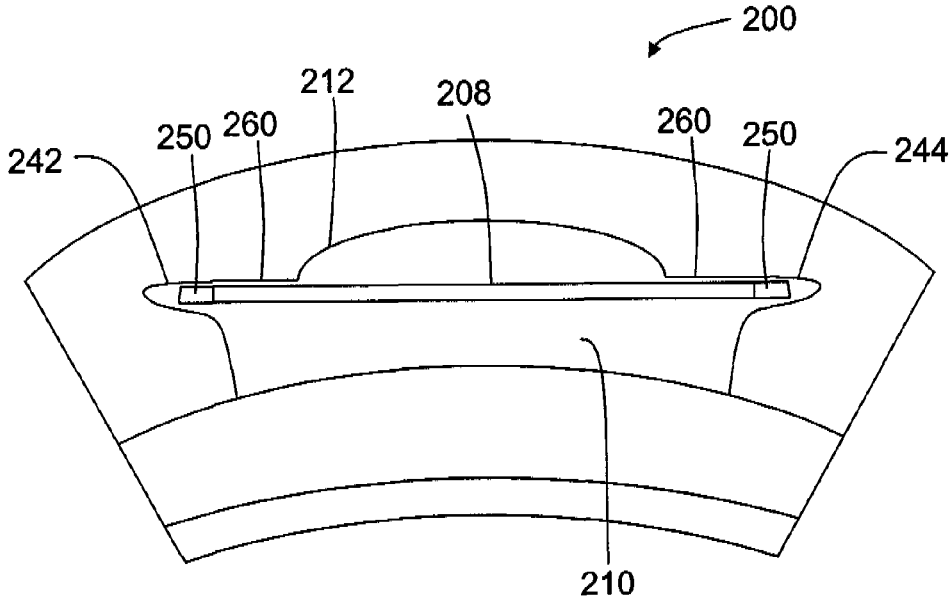
FIG. 9 is a view of the biasing mechanism shown in FIG. 7 and coupled within an alternative embodiment of the seal ring shown in FIG. 4.
Figure 10:
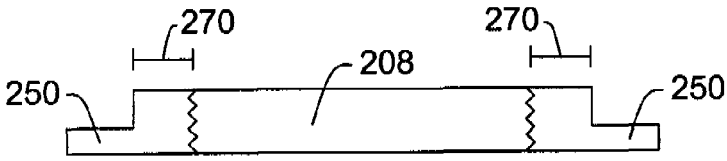
FIG. 10 is an illustration of the biasing mechanism shown in FIG. 7 and including indicia indicative of a contact point.

FIG. 9 is a view of biasing mechanism 208 having tabs 250 and coupled within an alternative embodiment of seal ring 200. Specifically, arcuate top wall 212 of cavity 210 includes a linear portion 260 extending from each notch 242 and 244. Each linear portion 260 is configured to engage biasing mechanism 208 such that bending forces within biasing mechanism 208 are distributed across the entire length of biasing mechanism 208 rather than being isolated at tabs 250. FIG. 10 is an illustration of locations 270 where linear portion 260 contacts biasing mechanism 208. As described above, biasing mechanism 208 is positively retained within cavity 210 in a friction fit created between tabs 250 and notches 242 and 244. Alternatively, tabs 250 may be retained within notches 242 and 244 by any one of, but not limited to, a tack weld, a screw, a pin, and/or glue.

Figure 11:
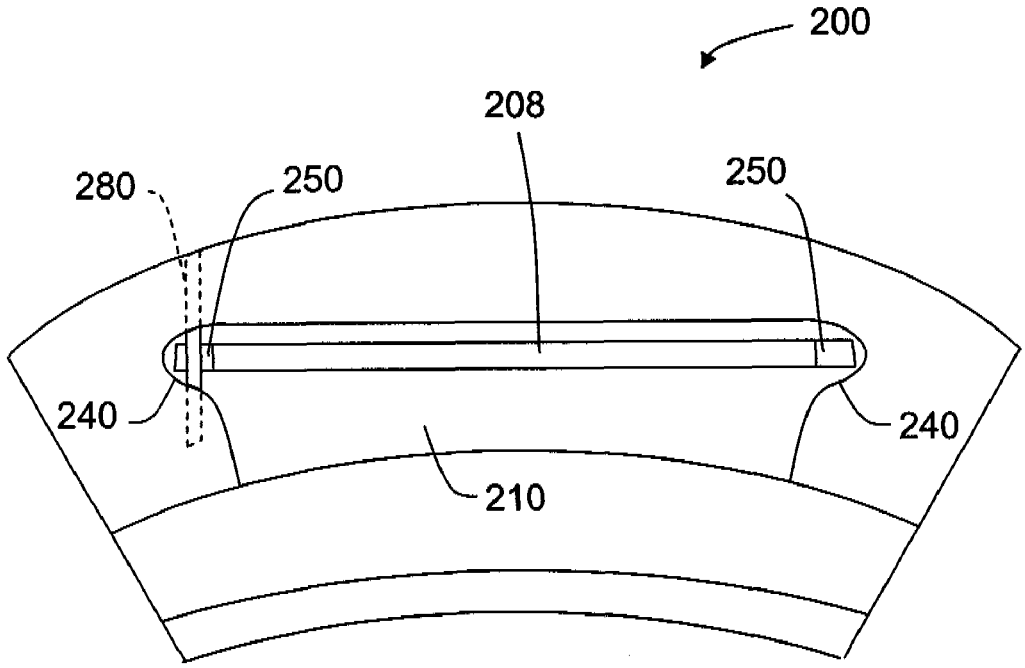
FIG. 11 is yet another embodiment of the seal ring shown in FIG. 4 and including a retaining pin.

FIG. 11 is a view of seal ring 200 including a pin 280 used to retain biasing mechanism 208 within cavity 210. In the illustrated embodiment, biasing mechanism 208 includes tabs 250 engaged with notches 240. Pin 280 is inserted through outer ring portion 206 such that pin 280 traverses notch 240 to facilitate retaining biasing mechanism 208 within cavity 210. Specifically, pin 280 traverses notch 240 such that tab 250 is retained between pin 280 and a back surface 282 of cavity 210.

The illustrated embodiment includes one pin 280 retaining one tab 250. In this embodiment, the second tab 250 is retained within notch 240 by one of friction, a tack weld, or glue. Alternatively, two pins 280 are inserted through outer ring portion 202 such that both tabs 250 are retained between pins 280 and cavity back surface 282. In yet another alternative embodiment, tabs 250 include an aperture therethrough and at least one pin 280 is inserted through the aperture of at least one tab 250 as pin 280 traverses notch 240. Furthermore, in another embodiment, biasing mechanism 208 may not include tabs 250. Accordingly, at least one pin 280 is inserted through at least one end of biasing mechanism 208 as pin 280 traverses notch 240. Moreover, pin 280 may be a screw.

Figure 12:
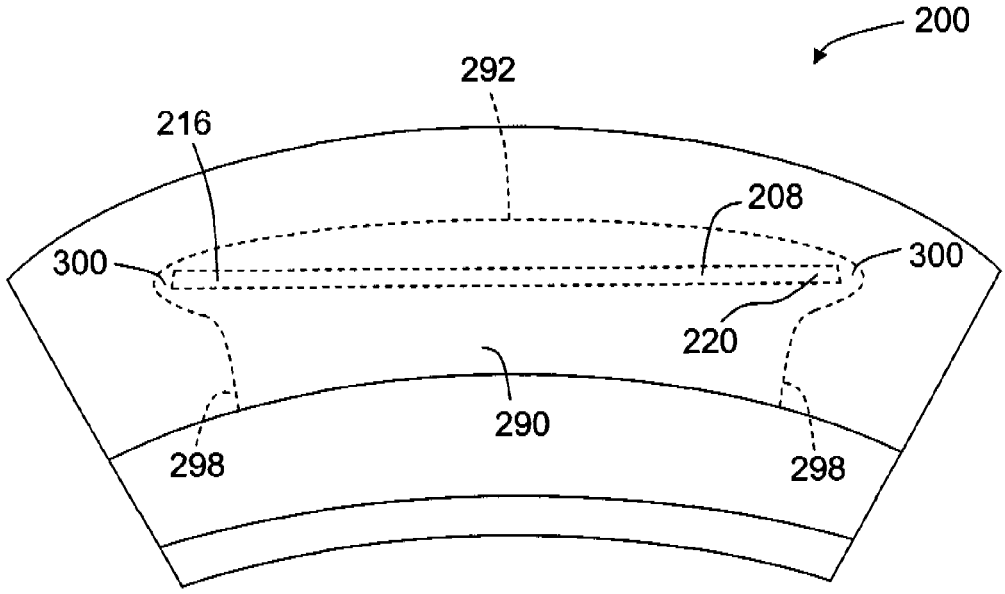
FIG. 12 is a front view of an another embodiment of the seal ring shown in FIG. 4.
Figure 13:
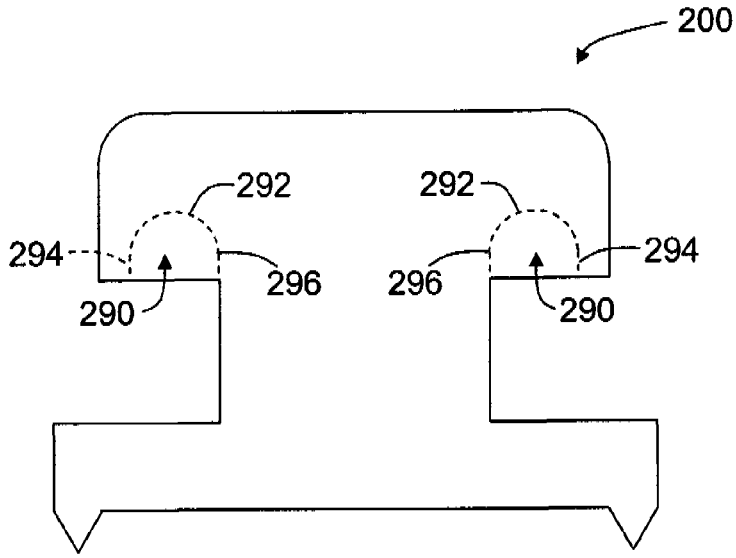
FIG. 13 is a side view of the seal ring shown in FIG. 12.

FIG. 12 is a front view of an alternative embodiment of seal ring 200 having cavity 290 formed entirely within outer ring portion 202; and FIG. 13 is a side view of seal ring 200 shown in FIG. 12. In this embodiment, cavity 290 is formed within outer ring portion 202 such that cavity 290 includes an arcuate top wall 292, a front wall 294, a back wall 296, and two opposing sidewalls 298. Sidewalls 298 each include a notch 300 formed therein. Notches 300 are configured to retain ends 216 and 220 of biasing mechanism 208 such that biasing mechanism 208 extends across cavity 290. Biasing mechanism 208 is positively retained within cavity 290 in a friction fit created between biasing mechanism ends 216 and 220 and notches 300, front wall 294, and back wall 296. Alternatively, biasing mechanism 208 may be positively retained within cavity 290 by any one of, but not limited to, a tack weld, a pin, a screw, and/or glue. Furthermore, biasing mechanism 208 may include tabs 250. Moreover, sidewalls 298 of cavity 290 may be shaped similar to sidewalls 214 shown in FIG. 4 or FIG. 5.

Figure 14:
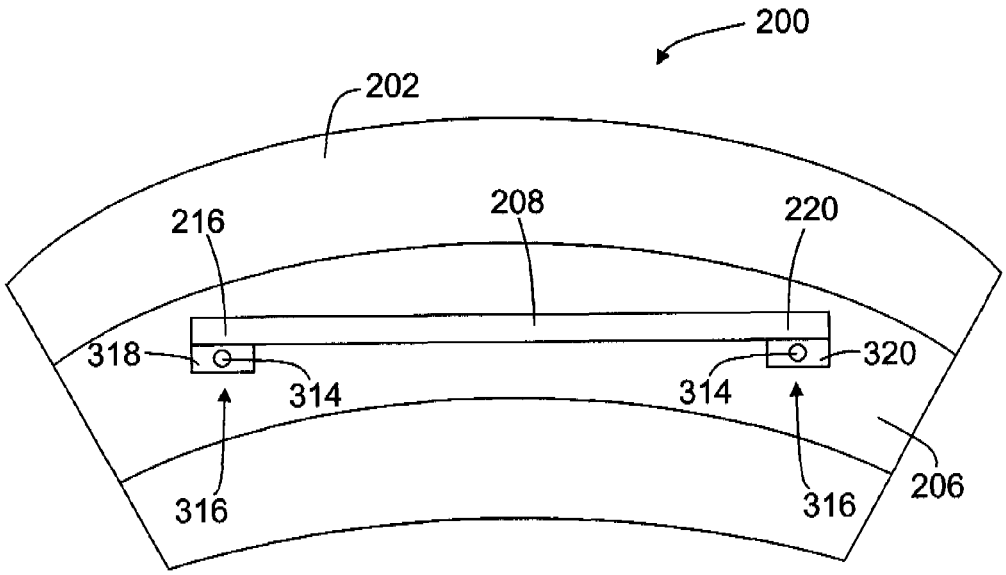
FIG. 14 is a front view of yet another embodiment of the seal ring shown in FIG. 4.
Figure 15:
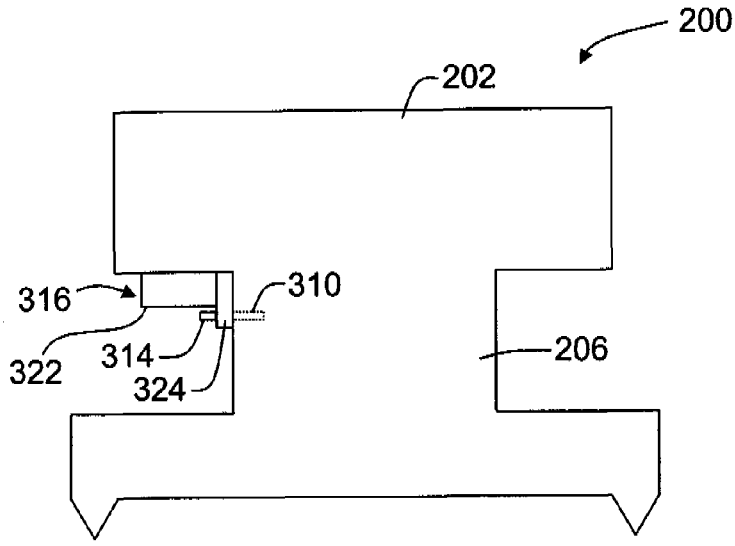
FIG. 15 is a side view of the seal ring shown in FIG. 14.

FIG. 14 is a front view of yet another embodiment of seal ring 200; and FIG. 15 is a side view of seal ring 200 shown in FIG. 14. In this embodiment, seal ring 200 does not include a cavity formed within outer ring portion 206. Rather, this embodiment includes a pair of threaded apertures 310 formed within neck portion 206 of seal ring 200. Each threaded aperture 310 is configured to retain a screw 314 therein. Biasing mechanism 208 includes a pair of bent tabs 316 extending therefrom. Specifically, a first bent tab 318 extends from biasing mechanism first end 216, and a second bent tab 320 extends from biasing mechanism second end 220. Each bent tab 316 includes a first member 322 coupled to biasing mechanism 208, and a second member 324 extending from first member 322. Second member 324 includes an aperture extending therethrough.

Biasing mechanism 208 is positioned against neck portion 206 such that it is radially inward from outer ring portion 202. Second member 324 of each bent tab 316 is aligned with threaded aperture 310 such that screw 314 is received through the aperture in second member 324 and extends through threaded aperture 310. As such, biasing mechanism 208 extends across neck portion 206 and is positively retained by screws 314.

Figure 16:
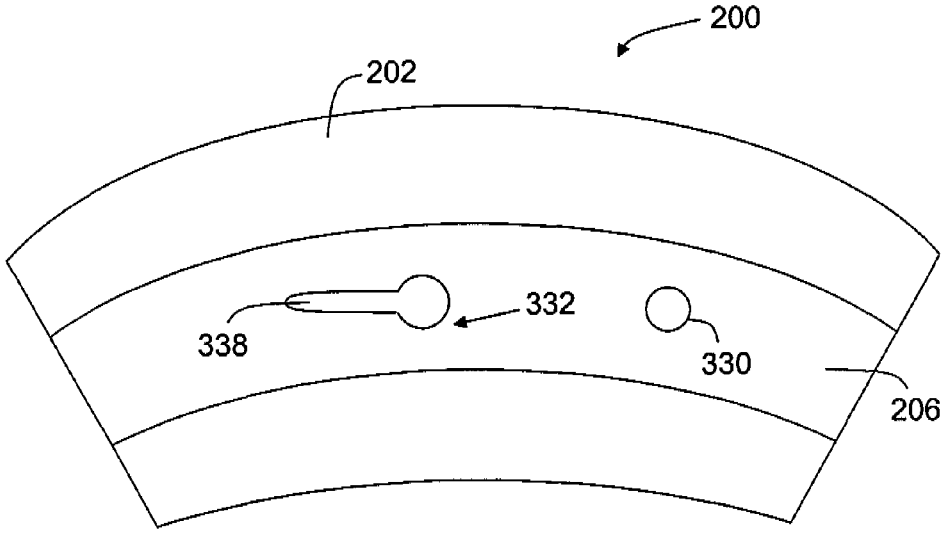
FIG. 16 is another embodiment of the seal ring shown in FIG. 4.
Figure 17:
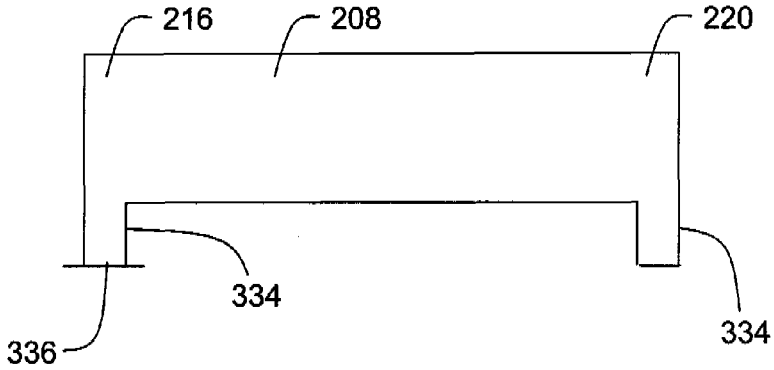
FIG. 17 is a view of a biasing mechanism that may be used with seal ring shown in FIG. 16.

FIG. 16 is another embodiment of seal ring 200; and FIG. 17 is a view of biasing mechanism 208 adapted for use with seal ring 200 shown in FIG. 16. Seal ring 200 includes an aperture 330 and a slotted aperture 332 formed within seal ring neck portion 206. Biasing mechanism 208 includes a pair of tabs 334 extending radially therefrom. Specifically, each end 216 and 220 of biasing mechanism 208 includes a tab 334. One of tabs 334 includes an engagement member 336 configured to engage slotted aperture 332. The tab 334 lacking engagement member 336 is positioned within aperture 330 and the tab 334 having engagement member 336 is inserted within slotted aperture 332 such that engagement member 336 slides into a retaining portion 338 of slotted aperture 332. As such, biasing mechanism 208 is positively retained within aperture 330 and slotted aperture 332.

The operation of seal ring 200 is substantially similar to the operation of seal ring 102 described in FIG. 3. One difference between the two operations is the outward biasing force induced on seal ring 200 by biasing mechanism 208. The additional outward biasing force assists to bias seal ring 200 to a larger diameter. As turbine load and steam pressures are increased, the radially outward force induced by biasing mechanism 208 must be overcome prior to seal ring 200 shifting radially inward. As a result, radially inward travel of seal ring 200 is delayed until predetermined operating conditions for turbine 10 are attained.

Each embodiment of the above-described seal ring facilitates positively retaining the biasing mechanism within the seal ring during shipment from a packing vendor to final assembly. Furthermore, the methods and apparatus described above prevent the biasing mechanism from moving during assembly. Specifically, the methods and apparatus described above prevent the biasing mechanism from falling out of the seal ring during shipment or assembly or being deformed as the seal ring is inserted into the seal assembly. As such, the methods and apparatus allow faster installation times and reduce the costs associated with seal assembly fabrication. Moreover, the above-described methods and apparatus allow for multiple cavities and biasing mechanisms and can, therefore, more equally distribute forces throughout the seal ring.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a seal ring for a seal assembly, it is understood that the apparatus and methods are not limited to seal rings or seal assemblies. Likewise, the seal ring components illustrated are not limited to the specific embodiments described herein, but rather, components of the seal ring can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a seal assembly for a turbine engine, said method comprising:

providing a seal ring having an arcuate inner ring portion, an arcuate outer ring portion, and a neck portion extending therebetween;

forming at least one recess within at least one of the outer ring portion and the neck portion, wherein a first aperture and a second aperture that are formed are each sized to receive a tab extending from each end of a biasing mechanism; and extending the biasing mechanism across the seal ring such that the biasing mechanism is positively retained within the at least one recess.

2. A method in accordance with claim 1 wherein forming at least one recess comprises forming a cavity having a pair of opposed side walls, wherein extending a biasing mechanism across the seal ring further comprises extending the biasing mechanism between the pair of sidewalls.

3. A method in accordance with claim 2 further comprising retaining the biasing mechanism within the cavity with at least one of a pin, a screw, glue, and a tack weld.

4. A method in accordance with claim 2 wherein said forming a cavity further comprises forming a notch within each of the two side walls, wherein extending the biasing mechanism between the pair of sidewalls comprises inserting a first end of the biasing mechanism in a first notch and a second end of a biasing mechanism in a second notch such that the biasing mechanism is retained between the notches.

5. A method in accordance with claim 4 wherein each end of the biasing mechanism is formed with a tab extending therefrom, said positively retaining the biasing mechanism further comprises configuring each notch to receive one of the tabs.

6. A method in accordance with claim 1 wherein said forming at least one recess comprises forming a pair of threaded apertures that are each sized to receive a threaded fastener therein for securing the biasing mechanism therebetween.

7. A seal assembly for a turbine engine, said seal assembly comprising:

a seal ring comprising an arcuate inner ring portion, an arcuate outer ring portion, and a neck portion extending therebetween;

at least one recess formed within at least one of said seal ring outer ring portion and said seal ring neck portion, said at least one recess comprises a first aperture and a second aperture; and a biasing mechanism extending chordially across said seal ring, a first end of said biasing mechanism received within said first aperture, a second end of said biasing mechanism received within said second aperture such that said biasing mechanism is retained within said at least one recess.

8. A seal assembly in accordance with claim 7 wherein said recess comprises a cavity having two side walls, said biasing mechanism extends between said two side walls.

9. A seal assembly in accordance with claim 8 wherein said biasing mechanism is retained within said cavity by at least one of a pin, a screw, glue, and a tack weld.

10. A seal assembly in accordance with claim 8 wherein said cavity further comprises a notch formed within each of said two side walls, each said notch sized to receive an end of said biasing mechanism such that said biasing mechanism is suspended between said notches.

11. A seal assembly in accordance with claim 10 wherein said biasing mechanism comprises a tab extending from each end, each said notch sized to receive one of said tabs.

12. A seal assembly in accordance with claim 7 wherein said at least one recess comprises a pair of threaded apertures that are each sized to receive a threaded fastener therein for securing the biasing mechanism therebetween.

13. A turbine engine comprising:

a seal assembly configured to reduce steam leakage within the turbine engine, said seal assembly comprising:

a seal ring comprising an arcuate inner ring portion, an arcuate outer ring portion, and a neck portion extending therebetween;

at least one recess formed within at least one of said seal ring outer ring portion and said seal ring neck portion, said at least one recess comprises a first aperture and a second aperture; and a biasing mechanism extending chordially across said seal ring, a first end of said biasing mechanism received within said first aperture, a second end of said biasing mechanism received within said second aperture such that said biasing mechanism is retained within said at least one recess.

14. A turbine engine in accordance with claim 13 wherein said recess comprises a cavity having two side walls, said biasing mechanism extends between said two side walls.

15. A turbine engine in accordance with claim 14 wherein said biasing mechanism is retained within said cavity by at least one of a pin, a screw, glue, and a tack weld.

16. A turbine engine in accordance with claim 14 wherein said cavity further comprises a notch formed within each of said two side walls, each said notch sized to receive an end of said biasing mechanism such that said biasing mechanism is suspended between said notches.

17. A turbine engine in accordance with claim 16 wherein said biasing mechanism comprises a tab extending from each end, each said notch sized to receive one of said tabs.

* * * * *

UNITED STATES PATENT AND TRADEMARK OFFICE

CERTIFICATE OF CORRECTION

PATENT NO. : 7,540,708 B2
APPLICATION NO. : 11/427866
DATED : June 2, 2009
INVENTOR(S) : Laurer et al.

It is certified that error appears in the above-identified patent and that said Letters Patent is hereby corrected as shown below:

Title Page, at Item (75) Inventors, delete "Kevin Joseph Barh" and insert therefor --Kevin Joseph Barb--.

Signed and Sealed this
Sixteenth Day of October, 2012

David J. Kappos

David J. Kappos
*Director of the United States Patent and Trademark Office*